US007357060B2

(12) United States Patent
Müller et al.

(10) Patent No.: US 7,357,060 B2
(45) Date of Patent: Apr. 15, 2008

(54) VEHICLE ARMOR

(75) Inventors: Markus Müller, Paderborn (DE); Christian Gnass, Bielefeld (DE); Wilfried Rostek, Paderborn (DE); Thomas Tröster, Salzkotten (DE); Rainer Lübbers, Paderborn (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 191 days.

(21) Appl. No.: 11/387,444

(22) Filed: Mar. 23, 2006

(65) Prior Publication Data

US 2006/0213361 A1 Sep. 28, 2006

(30) Foreign Application Priority Data

Mar. 24, 2005 (DE) ..... 10 2005 014 298

(51) Int. Cl.

| | |
|---|---|
| ***F41H 5/02*** | (2006.01) |
| ***C22C 38/42*** | (2006.01) |
| ***C22C 38/44*** | (2006.01) |
| ***C22C 38/54*** | (2006.01) |
| ***C21D 8/02*** | (2006.01) |

(52) U.S. Cl. ..... 89/36.02; 89/36.09; 420/91; 420/106; 420/108; 420/113; 148/579

(58) Field of Classification Search ..... 89/36.02, 89/36.09; 420/91, 106, 108, 113; 148/579
See application file for complete search history.

(56) References Cited

U.S. PATENT DOCUMENTS 1,649,548 A * 11/1927 Scheeler ..... 139/425 R
1,831,946 A * 11/1931 Breeler ..... 420/87
2,021,782 A * 11/1935 Clark et al. ..... 420/114
2,201,202 A * 5/1940 Reed ..... 148/233
RE22,072 E * 4/1942 Selmi et al. ..... 420/109
2,438,759 A * 3/1948 Liebowitz ..... 228/175

(Continued)

FOREIGN PATENT DOCUMENTS

DE 24 52 486 5/1975

(Continued)

OTHER PUBLICATIONS

Patent Abstracts of Japan; Bd. 2003; Nr. 12; Dec. 5, 2003; JP 2003 231915; JFE Steel KK; Aug. 19, 2003.

*Primary Examiner*—Bret Hayes
(74) *Attorney, Agent, or Firm*—Andrew Wilford

(57) ABSTRACT

A vehicle is armored the steps of sequentially making a steel plate with a thickness of 4 mm to 15 mm of by weight

| | |
|---|---|
| 0.2 to 0.4% | carbon, |
| 0.3 to 0.8% | silicon, |
| 1.0 to 2.5% | manganese, |
| max. 0.02% | phosphorous, |
| max. 0.02% | sulfur, |
| max. 0.05% | aluminum, |
| max. 2% | copper, |
| 0.1 to 0.5% | chromium, |
| max. 2% | nickel |
| 0.1 to 1% | molybdenum, |
| 0.001 to 0.01% | boron, |
| 0.01 to 1% | tungsten, |
| max. 0.05% | nitrogen, and |
| balance | iron and impurities. |

This plate is heated to above the $AC_3$ temperature and deformed without cooling in a press. While still in the press, the steel plate is cooled and cured. Then the deformed and cured steel plate is taken out of the press and mounted on the motor vehicle without significant further working or shaping.

7 Claims, 1 Drawing Sheet

U.S. PATENT DOCUMENTS

| | | | | | |
|---|---|---|---|---|---|
| 3,642,468 | A | * | 2/1972 | Nagashima et al. | 420/114 |
| 3,656,917 | A | * | 4/1972 | Kikkawa et al. | 420/90 |
| 4,132,342 | A | * | 1/1979 | Nitto et al. | 228/136 |
| 4,645,720 | A | * | 2/1987 | Pircher et al. | 428/683 |
| 4,740,255 | A | * | 4/1988 | Manton | 148/334 |
| 5,122,336 | A | * | 6/1992 | Roux et al. | 420/108 |
| 5,192,376 | A | * | 3/1993 | Tanabe et al. | 148/520 |
| 5,458,704 | A | * | 10/1995 | Bobbert et al. | 148/547 |
| 5,487,795 | A | * | 1/1996 | Kim et al. | 148/520 |
| 5,672,216 | A | * | 9/1997 | Robic | 148/527 |
| 6,524,404 | B2 | * | 2/2003 | Gehringhoff et al. | 148/320 |
| 7,048,811 | B2 | * | 5/2006 | Ohgami et al. | 148/330 |
| 2004/0163439 | A1 | | 8/2004 | Wilhelm et al. | |

FOREIGN PATENT DOCUMENTS

| | | |
|---|---|---|
| DE | 197 23 655 | 12/1997 |
| DE | 197 43 802 | 3/1999 |
| DE | 200 14 361 | 10/2000 |
| DE | 100 16 798 | 11/2001 |
| DE | 100 49 660 | 4/2002 |
| DE | 102 08 216 | 3/2003 |
| DE | 102 20 323 | 8/2003 |
| DE | 102 46 164 | 4/2004 |
| DE | 103 07 184 | 4/2004 |
| DE | 103 06 063 | 8/2004 |
| EP | 0 423 004 | 4/1991 |
| EP | 1 052 296 | 11/2000 |
| EP | 697 07 066 | 10/2001 |
| EP | 1 335 036 | 8/2003 |
| EP | 1 431 407 | 6/2004 |
| GB | 1 490 535 | 11/1977 |
| WO | WO2005/078143 | 8/2005 |

* cited by examiner

VEHICLE ARMOR

FIELD OF THE INVENTION

The present invention relates to vehicle armor. More particularly this invention concerns an vehicle armor element made of hardened steel between 4 mm and 15 nm thick.

BACKGROUND OF THE INVENTION

Vehicles nowadays are armored against projectiles with steel parts (ballistic protection) where to starts with a special type of armor steel is used. Armor steel is slightly alloyed steels of great hardness.

EP 1,052,296 describes by way of example, a steel alloy characterized by a low carbon content and carbon/nitride-forming vanadium. The alloy is formed in mass percentages, namely, out of, by weight

| | |
|---|---|
| 0.15 to 0.2% | carbon, |
| 0.1 to 0.5% | silicon, |
| 0.7 to 1.7% | manganese, |
| max. 0.02% | phosphorus, |
| max. 0.005% | sulfur, |
| max. 0.01% | nitrogen, |
| 0.009 to 0.1% | aluminum, |
| 0.5 to 1.0% | chromium, |
| 0.2 to 0.7% | molybdenum, |
| 1.0 to 2.5% | nickel, |
| 0.05 to 0.25% | vanadium, |
| max. 0.005% | boron, and |
| balance iron including standard impurities. | |

This alloy has a yield point of more than 1100 N/mm$^2$ and a minimum strength of 1250 N/mm$^2$. Its strength-to-break is above 10%. Known ballistic steels are ARMOX 500 T, 560 T and 600 T of SSAB or SECURE 400, 450, 500 and 600 of Thyssen Krupp Stahl.

According to the tempering of the steel, it has either high strength and low ductility, or a sufficient ductility with a lesser hardness. If the steel has to be made into armor plate in particular bent, it is necessary to use relatively expensive bending methods and tools. As a result, standard armored-steel plating is only machined a little for minor changes in dimensions. In particular, it can only be bent up to about 4% without breaking or cracking. As a result of these problems, armor, as a rule, is made up of many small parts that are held together in order to make a complex shape. Welding together the armor-steel parts decreases their hardness greatly in the heated regions. In order to get protection against projectiles for the armor, further armor plates are applied over the welded seams. Alternatively, the welded seams are backed up by an aramide layer. Armor that is not visible from the outside, therefore, takes up considerable inside space. The loss of space can lead to limiting of the functionality of the vehicle when these functions can no longer be built in. An example of this in conventional vehicles is the installation of side and overhead air bags.

German 103 06 063 describes a method of working armor steel. Each workpiece of armor steel is annealed to a temperature above the Curie point for a predetermined time to create an austenitic crystalline structure. Subsequently, the workpiece is cooled at a controlled speed above the critical cooling temperature of martensitic crystalline formation, and the still soft workpiece is shaped. Then the shaped workpiece is brought back to above the Curie point to recreate its hardness. The problem with this method is that reheating and rehardening after shaping creates stress and some deformation in the part. Maintaining exact dimensions is, however, very important for an armored part built into a motor vehicle.

German 24 52 486 describes a method for preshaping and hardening a steel sheet of modest thickness so as to approach accurate dimensioning. Here a plate of boron-alloyed steel is shaped, in less than five seconds, into its final shape between two indirectly cooled tools while being substantially deformed and held in the press while being cooled so quickly that a martensitically or bainetic fine-grained crystalline structure is produced. This method is recommended for extra strong, relatively thin parts and complex shaped and accurate dimensions for structural and safety-related parts, such as A and B-columns or shock absorbers in the civilian motor-vehicle industry. As a result, one of the typical sheets has a thickness of 3 mm or less, and steel with a low carbon content is used. Tests of these steels with respect to the ballistic strength produces a substantially poorer outcome relative to the armor steels available on the market, in particular, it is necessary to use substantially lighter pieces.

German 197 43 802. describes a method of making a metallic-shaped parts for motor vehicles for regions of high ductility. To this end, a plate is prepared of a steel alloy that has as a percentage of weight a content of

| | |
|---|---|
| 0.18% to 0.3% | carbon, |
| 0.1% to 0.7% | silicon, |
| 1.0% to 2.5% | manganese, |
| max. 0.025% | phosphorous, |
| 0.1% to 0.8% | chromium, |
| 0.1% to 0.5% | molybdenum, |
| max. 0.01% | sulfur, |
| 0.02% to 0.05% | titanium, |
| 0.002% to 0.005% | boron, |
| 0.01% to 0.06% | aluminum, and |
| balance iron, inc. smelting impurities. | |

This known alloy is particularly good for hot shaping and for armor purposes, however, the wall thickness must be so large that its use is almost ruled out because of weight.

EP 1 335 036 describes a method for making a structural element protected by aluminum against corrosion and produced by piece coating and hot shaping. The goal is to avoid the cool shaping of the aluminum layer.

German 102 08 216 describes a method for producing a partially hardened part where regions of the part are maintained isothermally after austenitizing until the ferrite or perlite is converted and in the subsequent hardening process the regions do not harden into martensite.

German 102 46 164 describes a hot-shaping process for plates made from a flexible rolled strip.

German 103 07 184 describes the prerough and finish shaping of a plate from preheat without intermediate heat.

German 100 49 660 describes the hot shaping of a patchwork plate.

German 197 23 655 describes the hot-shaping method of a steel-plate product where the steel is hardened but kept in fluent condition by parts or recesses of a tool in regions in which it is to be worked afterward.

German 100 16 798 describes armor for a security vehicle where the element according to the invention is comprised of hot-rolled, austenitic manganese steel that has no edge carbide layer and that becomes very hard when cool-shaped.

According to the method, the hot rolled-edge carbide layer is trimmed off both sides, or the formation of this layer is avoided by the use of a protective gas.

U.S. Pat. No. 5,458,704 describes a hot-rolled armor steel that contains by weight

| | |
|---|---|
| 0.25 to 0.32% | carbon, |
| 0.05 to 0.75% | silicon, |
| 0.10 to 1.50% | manganese, |
| 0.90 to 2.00% | chromium, |
| 0.10 to 0.70% | molybdenum, |
| 1.20 to 4.50% | nickel, |
| 0.01 to 0.08% | aluminum, |
| max. 0.015% | phosphorous, |
| max. 0.005% | sulfur, |
| max. 0.012% | nitrogen, and |
| balance iron and smelting impurities. | |

This steel is provided for armor with a wall thickness of at is least 50 mm.

German 200 14 361 describes a one-piece hot-shaped B-column with a very strong upper part and a relatively ductile lower part in its construction, where parts of the lower part are insulated in the oven to prevent austenitizing, or before hardening, are cooled without reaching the critical temperature.

German 697 07 066 describes a hot-shaped B-column with a special hardness distribution that extends arcuately so when cooled the highest hardness level is in the middle of the B-column.

OBJECTS OF THE INVENTION

It is therefore an object of the present invention to provide an improved method of making an improved armor steel.

Another object is the provision of such an improved method of making an improved armor steel that overcomes the above-given disadvantages, in particular that is very hard, but that can be accurately shaped into relatively complex shapes.

SUMMARY OF THE INVENTION

A vehicle is armored according to the invention the steps of sequentially making a steel plate with a thickness of 4 mm to 15 mm of by weight

| | |
|---|---|
| 0.2 to 0.4% | carbon, |
| 0.3 to 0.8% | silicon, |
| 1.0 to 2.5% | manganese, |
| max. 0.02% | phosphorous, |
| max. 0.02% | sulfur, |
| max. 0.05% | aluminum, |
| max. 2% | copper, |
| 0.1 to 0.5% | chromium, |
| max. 2% | nickel |
| 0.1 to 1% | molybdenum, |
| 0.001 to 0.01% | boron, |
| 0.01 to 1% | tungsten, |
| max. 0.05% | nitrogen, and |
| balance | iron and impurities. |

This plate can to start with be generally flat and planar. It is then heated to above the $AC_3$ temperature and deformed without cooling in a press. While still in the press, the steel plate is cooled and cured. Then the deformed and cured steel plate is taken out of the press and mounted on the motor vehicle without further shaping steps. Shaping here is intended to include deep drawing, bending, or forging, but not edge trimming or separation into several different parts.

It is worth noting that, relative to thinner plate, substantially longer heating time is used. Thus the basic crystalline structure of the workpiece is austenitized above the $AC_3$ temperature. The austenitized steel plate is shaped in a die that can be cooled. During the shaping process the heated steel plate is cooled by conduction into the dies so that there is formation of martensite and bainite. In this manner the steel is hardened. In order to harden it all the way through, the plate has to be heated above the $AC_3$ temperature.

The method further has according to the invention the step of tempering the plate in the press.

It is important to note that substantially longer heating time is used than what is used with hot shaping of thin plate. In this manner, the crystalline structure of the workpiece is austenitized above the $AC_3$ temperature all the way through. The austenitized steel plate is shaped in a tool that is cooled or that can be cooled. During the shaping process, the heated steel plate is cooled by conduction from the tool such that there is a martensitic and bainetic conversion. In this manner, the steel is hardened. If the plate is not heated all the way through to above the $AC_3$ point, there is only a partial crystal conversion and only a partial hardening. According to application, the reduced hardness can be enough for steel for use as armoring. What is important are the substantially greater shaping properties and the dimensionally accurate crack-free final shaping and hardening produced in the tool during the shaping step of the hardened workpiece.

Although hot shaping and hardening in a tool are well known, there is, nonetheless, no teaching of application to a ballistic steel and the required wall thickness up to 15 mm. The deep-drawing and shaping possibilities and limitations are unknown in this application. It is also unknown to what thickness a through-going hardening of ballistic steel is possible.

In general experiments that form the basis of this invention, produce armor-steel plate up to 8 mm thick, preferably with a wall thickness of 5 mm and 6 mm by heating above the $AC_3$ point for austenitizing with subsequent hardening in a die. With this process it is possible to produce extremely strong armor elements with very accurate dimensions. Since the shape corresponds perfectly to that needed on the inside of the vehicle, it is possible to make the armor very light. At the same time the number of weld seams is reduced to a fraction so that additional precautions regarding these seams are not needed. As a result of better material use it is possible to use this armor plate, for example, in a vehicle door or side or roof panel provided with side and head air bags.

In order to finish the armor steel, it can be tempered. As a result armor can be produced whose final shape corresponds exactly to what is needed in the armored vehicle where it will be installed, with the armor plate being fully hardened in this final shape. As a result, it is above all possible to bend through more than 4°. By deep-drawing and/or bending, it is possible to make 90° bends. Thus the actual vehicle parts can themselves be made out of armor steel, these parts constituting, for example, a B-column or even a complete deep-drawn door that is itself fully made of armor steel. This can replace a part that is made according to the prior art or a large number of small welded together pieces. This reduces the number of weld seams and the associated safety problem as well as the cost to reduce these safety risks. The single part is very accurately dimensioned so that it can easily be formed into virtually all the pieces needed to virtually make up a motor vehicle.

The process of hot shaping and hardening in a die produces the desired ballistic resistance, since the finished part is much harder than the known conventional parts. This means that the steel being used must be temperable and simultaneously very durable. It is, therefore, necessary to develop a material that on the one hand is extremely durable, much more than standard hot-shaped steel, and on the other hand can be made hard enough to be comparable to conventional ballistic steel.

Durability can be increased with additives such as s manganese, molybdenum and chromium. Extreme hardness is obtained using such additives as carbon, silicon and tungsten. In particular, tungsten encourages formation of carbides and increases the strength, yield point and ductility. It is particularly advantageous to use a steel alloy that has the following percentages by weight

| | |
|---|---|
| 0.2 to 0.4% | carbon, |
| 0.3 to 0.8% | silicon, |
| 1.0 to 2.5% | manganese, |
| max. 0.02% | phosphorous, |
| max. 0.02% | sulfur, |
| max. 0.05% | aluminum, |
| max. 2% | copper, |
| 0.1 to 0.5% | chromium, |
| max. 2% | nickel |
| 0.1 to 1% | molybdenum, |
| 0.001 to 0.1% | boron, |
| 0.01 to 1% | tungsten, |
| max. 0.05% | nitrogen, and |
| balance | iron and impurities. |

This steel alloy has a hardness of up to 580 HV30.

A particular advantage embodiment of the invention has by weight the following composition of

| | |
|---|---|
| 0.29 to 0.31% | carbon, |
| 0.4 to 0.65% | silicon, |
| 1.5 to 1.6% | manganese, |
| 0.012 to 0.016% | phosphorous, |
| 0.0008 to 0.0017% | sulfur |
| 0.02 to 0.03% | aluminum, |
| max. 1.05% | copper, |
| 0.25 to 0.265%, | chromium |
| max. 1.05% | nickel, |
| 0.4 to 0.5% | molybdenum, |
| 0.002 to 0.003% | boron, |
| 0.01 to 0.35% | wolfram |
| 0.01 to 0.015% | nitrogen, and |
| balance iron and smelting impurities. | |

The values of copper and nickel can vary within the above given range. In a preferred embodiment both of these metals stand at a ratio of 1:1.

The steel alloy according to the invention is particularly good with respect to the ease with which it can be shaped when soft and annealed in a die so as to be hardened to the level needed as use for armor.

The steel alloy according to the invention is not only particularly useful for armoring vehicles, for example, armored cars and also can be used as armored elements in motor vehicle construction. The invention is not limited to this application. It could also be used in military tanks and personnel transporters with a plate thickness in the 12 mm range. In battlefield vehicles such as a leopard, the shaped parts according to the invention can be used as armor. Normally these shaped parts as a result of their considerable wall thickness are normally only part of the armor and do not themselves provide full armor capacity.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
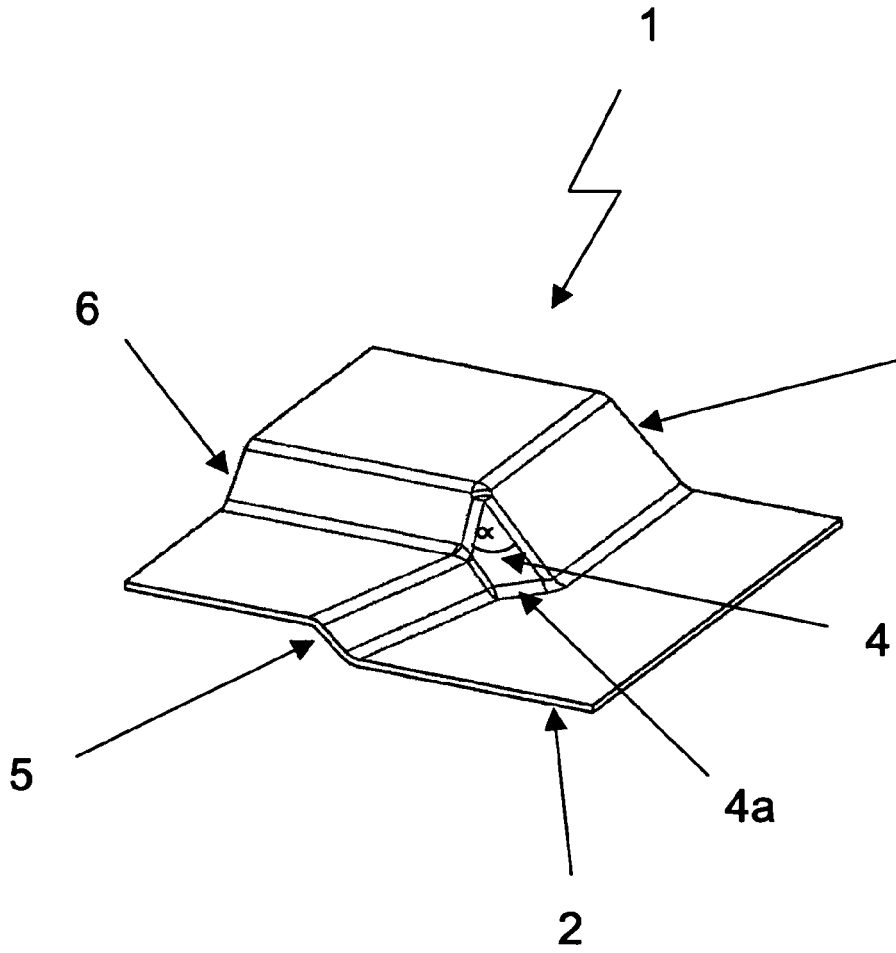
FIG. 1 is a perspective view of a vehicle armor part according to the invention.

FIG. 1 shows a hot-shaped and hardened part 1 of steel armor steel plate. The plate has a composition by weight of

| | |
|---|---|
| 0.29 to 0.31% | carbon |
| 0.4 to 0.65% | silicon, |
| 1.5 to 1.6% | manganese, |
| 0.012 to 0.016% | phosphorous, |
| 0.0008 to 0.0017% | sulfur, |
| 0.02 to 0.03% | aluminum, |
| max. 1.05% | copper, |
| 0.25 to 0.265% | chromium, |
| max. 1.05% | nickel, |
| 0.4 to 0.5% | molybdenum, |
| 0.002 to 0.003% | boron, |
| 0.01 to 0.35% | wolfram, |
| 0.01 to 0.015% | nitrogen, |
| balance iron and smelting impurities. | |

The part 1 has a wall thickness 2 of 60 mm. It has parts 3 to 6 that are highly shaped. In the regions 3, 5 and 6 an angle greater than 45° has been formed. In the part 4, there is an acute angle α whose lower line 4*a* extends at an angle. The part 1 in spite of its complex shape is totally unitary and has no weld seams. The necessary hardness for ballistic protection exists at every location even in the deformed regions 3, 4, 5 and 6. The part 1 is hardened to its final shape in a die. It is thus dimensionally very accurate.

Figure 2:
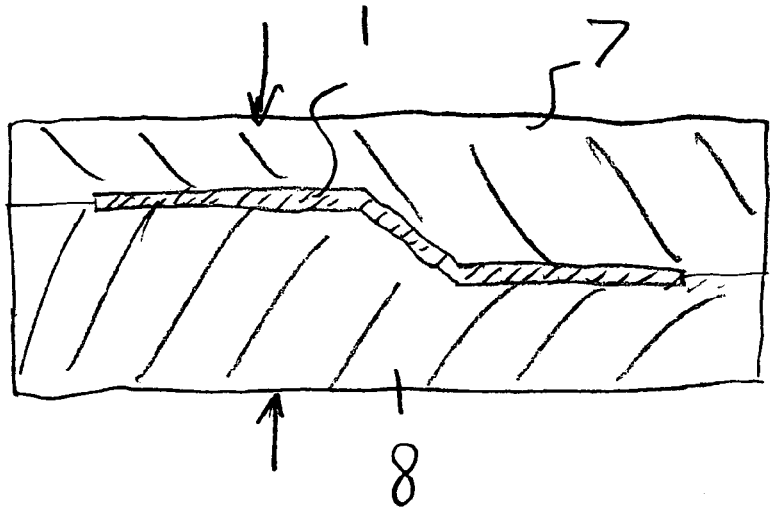
FIG. 2 is a simplified section showing how the part is made.

FIG. 2 shows how the part 1 is made, starting from an unillustrated plate that is heated above the $AC_3$ point and compressed between two dies 7 and 8 that deform it. It is then hardened and subsequently cooled between the two dies 7 and 8.

We claim:

1. A method of armoring a vehicle comprising the steps of sequentially:

making a steel plate with a thickness of 4 mm to 15 mm of by weight

| | |
|---|---|
| 0.2 to 0.4% | carbon, |
| 0.3 to 0.8% | silicon, |
| 1.0 to 2.5% | manganese, |
| max. 0.02% | phosphorous, |
| max. 0.02% | sulfur, |
| max. 0.05% | aluminum, |
| max. 2% | copper, |
| 0.1 to 0.5% | chromium, |
| max. 2% | nickel |
| 0.1 to 1% | molybdenum, |
| 0.001 to 0.01% | boron, |
| 0.01 to 1% | tungsten, |
| max. 0.05% | nitrogen, and |
| balance | iron and impurities; |

heating the steel plate to above the $AC_3$ temperature;

deforming the heated steel plate in a press;

while still in the press, cooling and curing the steel plate; and taking the deformed and cured steel plate out of the press and mounting it on the motor vehicle without further shaping steps.

2. The method defined in claim 1, further comprising the step of tempering the plate in the press.

3. The method defined in claim 1 wherein the ratio of copper to nickel is 1:1.

4. A shaped armor steel plate made by the method of claim 1.

5. The shaped armor steel plate defined in claim 1 wherein the plate is formed into a piece of a vehicle body.

6. The shaped armor steel plate defined in claim 5 wherein the plate is deformed through angle greater than 4°.

7. The shaped armor steel plate defined in claim 4 wherein the plate has a ratio on nickel to copper equal substantially to 1:1.

* * * * *